US005630876A

United States Patent [19]

Ehinger et al.

[11] Patent Number: 5,630,876

[45] Date of Patent: May 20, 1997

[54] COATING PRODUCT SPRAYER DEVICE

[75] Inventors: Pierre Ehinger, Faverges; Patrice Gory, Fontaine, both of France

[73] Assignee: Sames S.A., Meylan, France

[21] Appl. No.: 412,054

[22] Filed: Mar. 28, 1995

[30] Foreign Application Priority Data

Mar. 30, 1994 [FR] France ..... 94 03751

[51] Int. Cl.[6] ..... B05B 3/18

[52] U.S. Cl. ..... 118/323; 118/315; 118/300; 239/751

[58] Field of Search ..... 118/323, 313, 118/315, 300; 239/750, 751, 752, 753, 650, 651, 665, 666; 264/30

[56] References Cited

U.S. PATENT DOCUMENTS

| | | | |
|---|---|---|---|
| 2,321,983 | 6/1943 | Brackett | 91/45 |
| 2,744,033 | 5/1956 | Juvinall | 117/93 |
| 2,764,893 | 10/1956 | Falkenberg | 74/25 |
| 2,911,835 | 11/1959 | Smith | 74/37 |
| 3,885,066 | 5/1975 | Schwenninger | 427/314 |
| 4,133,255 | 1/1979 | Guice | 98/115 SB |
| 4,233,933 | 11/1980 | Gray et al. | 118/314 |
| 4,901,985 | 2/1990 | Soofi | 264/30 |

FOREIGN PATENT DOCUMENTS 0480663 4/1992 European Pat. Off. .

OTHER PUBLICATIONS

Patent Abstracts of Japan: Ranzubaagu Ootomooteibu KK, Coating Device, Oct. 1992, vol. 16, No. 254 (C–1000) & JP–A–04 197 465, Jul. 17, 1992 –Abridgment.

*Primary Examiner*—Donald E. Czaja
*Assistant Examiner*—Calvin Padgett
*Attorney, Agent, or Firm*—Loeb & Loeb LLP

[57] ABSTRACT

A coating product sprayer device forming an overhead machine includes a beam supporting at least one carriage carrying at least one sprayer. The beam comprises two longitudinal members that are parallel to and spaced from each other over the greater part of their length. The carriage is at least partially accommodated in the space between the two longitudinal members. This device minimizes disturbance of the flow of air near the sprayer.

16 Claims, 4 Drawing Sheets

COATING PRODUCT SPRAYER DEVICE

BACKGROUND OF THE INVENTION

1. Field of the Invention

The invention concerns a device for spraying coating product such as is used for coating automobile vehicle bodies, for example.

2. Description of the Prior Art

On prior art production lines, the bodies are moved by a conveyor and the coating product sprayer machine includes a gantry supporting a horizontal beam perpendicular to the path of the bodies. This beam carries one or more coating product sprayers. These machines, often called overhead machines, are of capital importance in the coating of objects to be painted, in particular when these objects have many horizontal surfaces and surfaces perpendicular to the path of objects on the conveyor, such as the front, the hood, the roof, the trunk and the rear of an automobile vehicle body.

In some applications, for example coating with metallic paint, an overhead machine is used including a single carriage carrying one or more sprayers and moving along the beam at speed in the order of 1.5 m/s. This fast scanning movement coats all plane surfaces with a minimum number of coating product, spray air and (where applicable) high voltage supply systems.

The fast movement of the carriage on the beam creates turbulence which disturbs the flow of air near the sprayer(s). This affects the quality of the deposit and the sprayers, the carriage and the beam tend to become soiled quickly, requiring regular interruption of operation for cleaning the installation. Virtually constant surveillance of the installation and numerous manual operations are required.

In the prior art devices the carriages are driven by belts or chains on the side of the beam facing towards the bodies or on a lateral face of the beam. The fast movement of the carriage(s) detaches particles of dust or dried coating product adhering to these drive systems and because of the turbulence caused near the sprayer(s) some of these particles are deposited onto the bodies, which spoils the surface finish.

In the case of a conventional beam the carriage is sometimes asymmetrical, i.e. provided with a cantilever arm on one side only of the beam. If the beam is able to rotate about its major axis, in particular to enable the sprayer to be at all times perpendicular to the surface to be coated, including the front and the rear of the body, the asymmetry of the carriage leads to different behavior of the flow of air around the sprayer according to the direction of rotation of the beam, which is all the more difficult for the operator to control.

Finally, the prior art devices are heavy: the gantries which support the beams must be sized accordingly. They are also bulky: the flow of air in the booth is disturbed.

The invention solves all of these problems.

SUMMARY OF THE INVENTION

The invention consists in a coating product sprayer device forming an overhead machine comprising a beam supporting at least one carriage carrying at least one sprayer wherein, over the greater part of its length, said beam is formed by two longitudinal members parallel to and spaced from each other and defining between them a space and said carriage moves between said longitudinal members and lies at least partially in said space.

In a preferred embodiment of the invention the device is installed in a spray booth provided with means for creating therein a dominant flow of air and said beam is disposed so that said dominant flow of air causes in the space defined between said two longitudinal members a flow of air in substantially the same direction as that in which said coating product is sprayed.

Thanks to the invention, the flow of air is only slightly disturbed since the dominant flow of air established in the booth by the ventilation system can be maintained as far as the vicinity of the sprayer(s). Turbulence no longer tends to soil the sprayers, the carriage or the beam and particles of dust and coating product are no longer drawn towards the surface to be coated.

Finally, the beam used has a small cross-section and is therefore light in weight, which reduces its inertia and enables the size of the supporting gantry and the motors which displace it to be optimized.

The invention further consists in a coating product sprayer device forming an overhead machine comprising a beam supporting at least one carriage carrying at least one sprayer, in which device at least part of said carriage carrying said sprayer is adapted to move perpendicularly to the axis of said beam.

The invention will be more clearly understood and other advantages of the invention will emerge more clearly from the following description of two embodiments of a coating product sprayer device in accordance with the invention given by way of example only and with reference to the appended drawings.

DETAILED DESCRIPTION OF THE PREFERRED EMBODIMENTS

Figure 1:
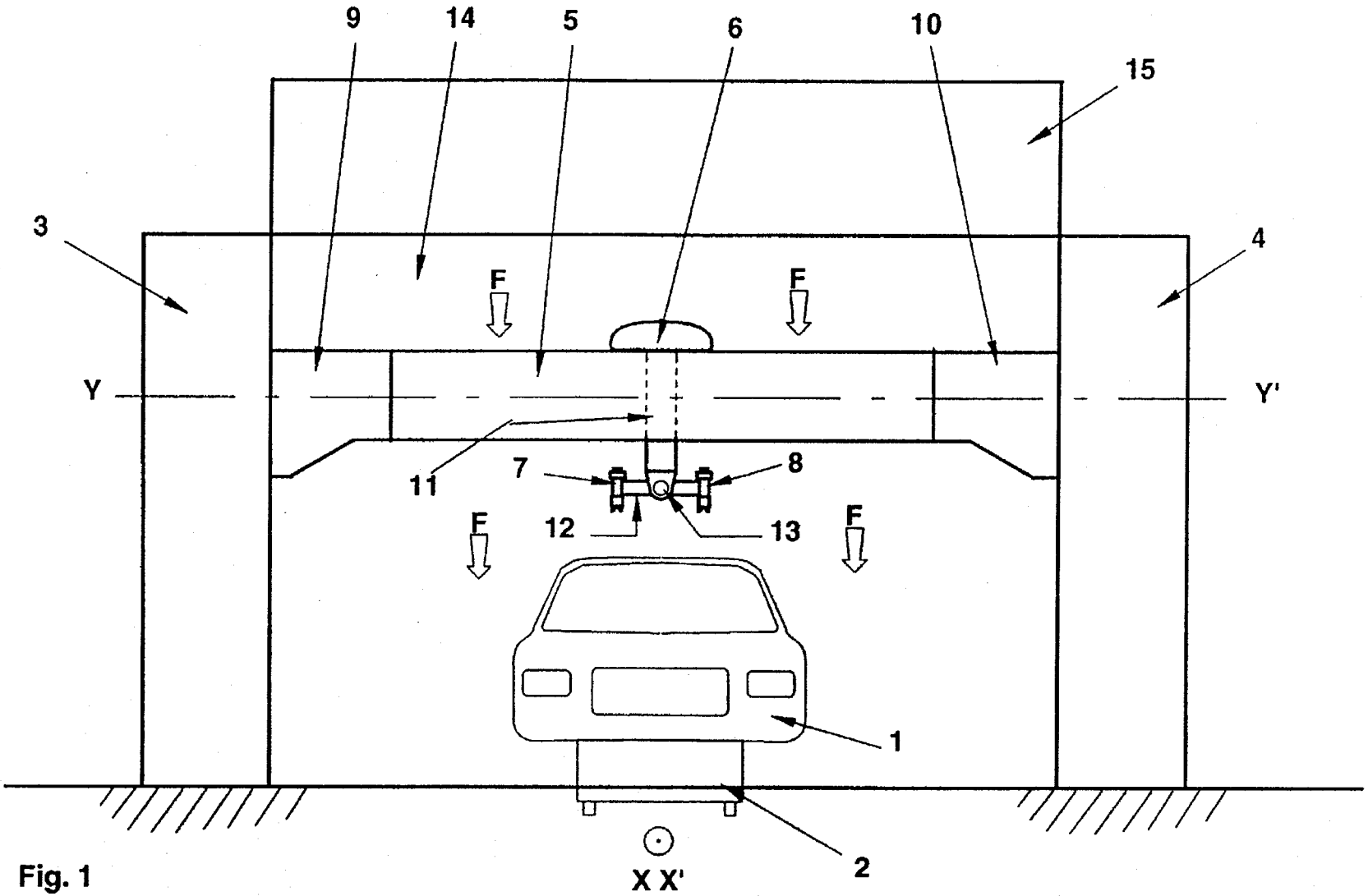
FIG. 1 is a diagrammatic view of part of an installation in accordance with the invention for coating automobile bodies.

The installation shown in FIG. 1 is designed to coat automobile bodies 1 carried by a conveyor 2 along a path along an axis XX'. It includes two gantries 3 and 4 disposed on either side of the path of the conveyor and supporting a beam 5 along which a carriage 6 can move. The movement of the carriage 6 enables it to sweep across all of the width of the body 1 in order to position two sprayers 7 and 8 opposite all the surfaces to be coated. The beam is attached to the gantries 3 and 4 by two bearings 9 and 10 which enable it to rotate about an axis YY' parallel to its greatest dimension. The bearings 9 and 10, and consequently the beam 5 and the equipment that it carries, are mobile vertically relative to the gantries 3 and 4 by drive systems that are known in themselves, for example as described in French patent application 94/00127.

A ventilation system 15 generates a dominant air current in the spray booth 14 containing the installation. This dominant air flow is a downward vertical air flow in the direction of the arrows F. The ventilation system 15 includes an air supply located in the plenum or ceiling of the booth, for example.

In accordance with one advantageous feature of the invention the sprayers 7 and 8 are mounted at the end of an extension 11 of the carriage, at the ends of an arm 12 pivoted at the center at a wrist 13 having a horizontal pivot axis. This mounting enables the relative altitude of the sprayers 7 and 8 to be varied. In this way, at the end of travel of the carriage 6 the outside sprayer can be lowered along the side of the body so that its spray area overlaps part of that of a sprayer carried by a lateral machine and used to coat the sides of the body.

Figure 2:
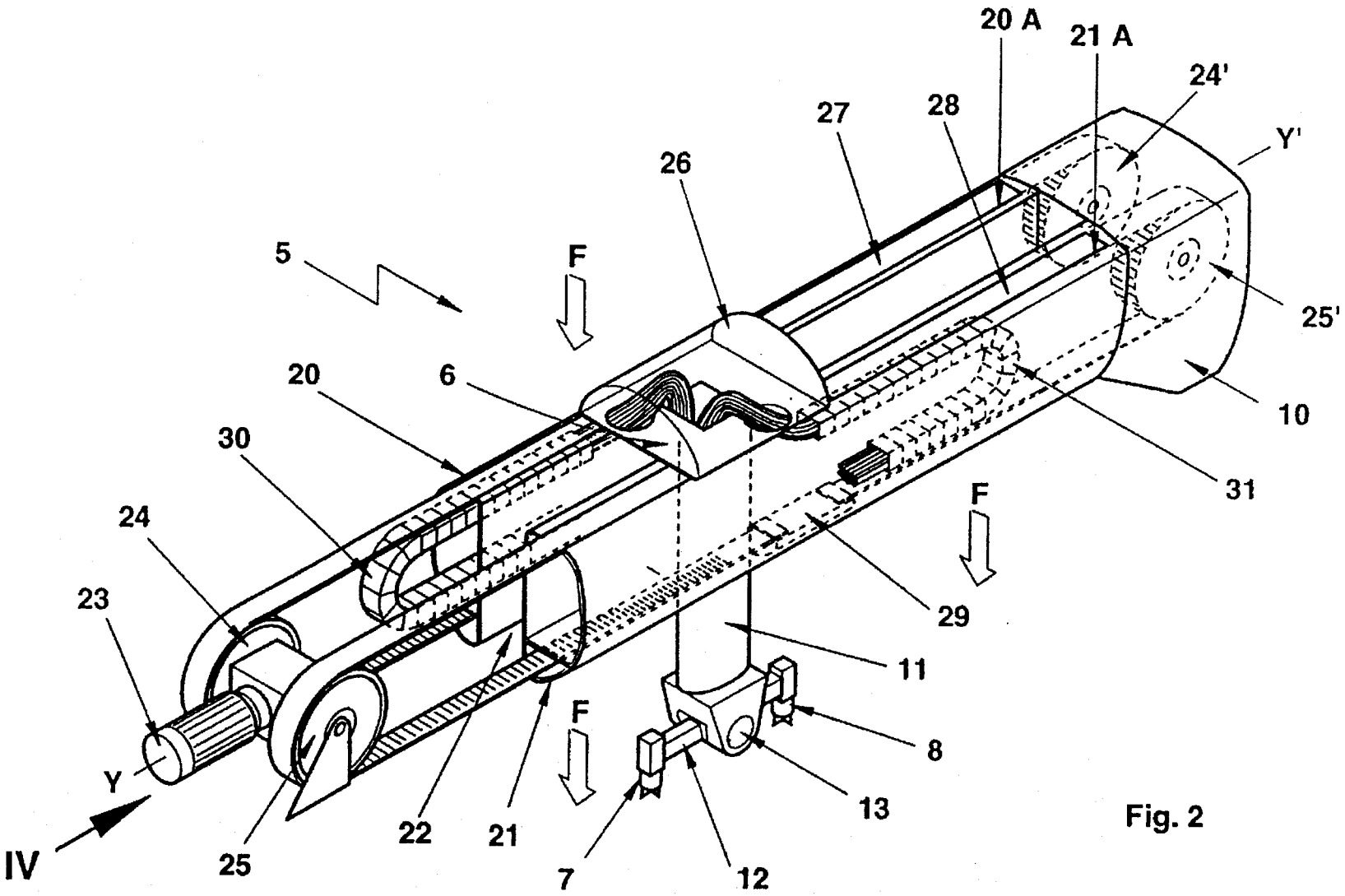
FIG. 2 is a diagrammatic perspective view of part of the beam of the overhead machine from FIG. 1.

FIG. 2 shows the beam 5 in perspective. It comprises over the greater part of its length two longitudinal members 20 and 21 of fiberglass-reinforced polyester or epoxy resin attached at their ends to the bearings 9 and 10. They are parallel to and spaced from each other to define between them a space 22 in which can move the extension 11 of the carriage 6 at the end of which the sprayers 7 and 8 are disposed. The upper part 26 of the carriage 6 is wider than the space 22 and rests on the longitudinal members 20 and 21.

The airflow created in the booth 14 and shown by the arrows F fills the space 22 at all times, which induces at the sprayers 7 and 8 a constant flow of air tending to entrain the particles of paint towards the body 1, which can be seen in FIG. 1. In this way the flow of air in the booth is not much disturbed at the location of the sprayers 7 and 8.

Even if the carriage 6 is moving rapidly, there is no reduction in pressure at the beam 5 because the partial vacuum that would otherwise tend to form to the rear of the end of the extension 11 is filled in immediately by air from the space 22. Permanent quasi-equilibrium is thus established.

This stability of the flow of air in the spraying area prevents recirculation of a cloud of particles of coating products towards the top of the booth: there is no risk of the longitudinal members 20 and 21 and the carriage 6 being soiled by unintentional reverse flow of product.

Also, the beam as so constituted is symmetrical about a vertical plane containing the axis YY'. It has the same aerodynamic and inertia effects on the drive systems for either direction of rotation about the axis YY'.

Displacement of the carriage along the axis YY' is driven by an electric motor 23 in one of the bearings 9 or 10 and driving two pulley wheels 24 and 25 associated with respective idler pulley wheels 24' and 25' in the other bearing. Two notched belts 27 and 28 each forming a closed loop are tensioned between the pulley wheels 24 and 24' and between the pulley wheels 25 and 25', respectively. They are housed inside the longitudinal members 20 and 21 and their outside surfaces are uncovered, facing respective openings 20A and 21A in the top walls of the longitudinal members. The belts 27 and 28 are slightly wider than the openings 20A and 21A so that the latter are covered and closed off completely. This prevents soiling of the interior of the longitudinal members 20 and 21.

The carriage 6, specifically its upper part 26, is attached to the two belts 27 and 28: it is displaced along the axis YY' by the movement of the belts. Counterweights 29 accommodated in the longitudinal members 20 and 21 are driven in the opposite direction to the carriage 6 by the belts 27 and 28, which prevents excessive swaying motion being imparted to the gantries 3 and 4.

Because of the position of the belts 27 and 28 and the rotation of the beam 5 about the axis YY' any soiling caused by this drive system can only affect the side opposite the object to be coated, which prevents it being drawn towards the latter.

Spoolers 30 and 31 are housed in the respective longitudinal members 20 and 21 and contain supply hoses for the coating product, spray air and drive air and possibly electrical power supply cables in the case of an electrostatic sprayer device. The spoolers, the hoses and the cables are entirely enclosed within the beam 5: they are protected from soiling and a leak from one of the hoses will not necessarily pollute the body being coated at the time.

To facilitate maintenance of the installation, and in accordance with an advantageous feature of the invention, the coating product supply hoses can be separated from the other hoses and cables. In the particular case of an electrostatic coating product sprayer installation, and because the longitudinal members are made from an insulative material, it is possible to maintain the spoolers and hoses at different electrical potentials.

Figure 3:
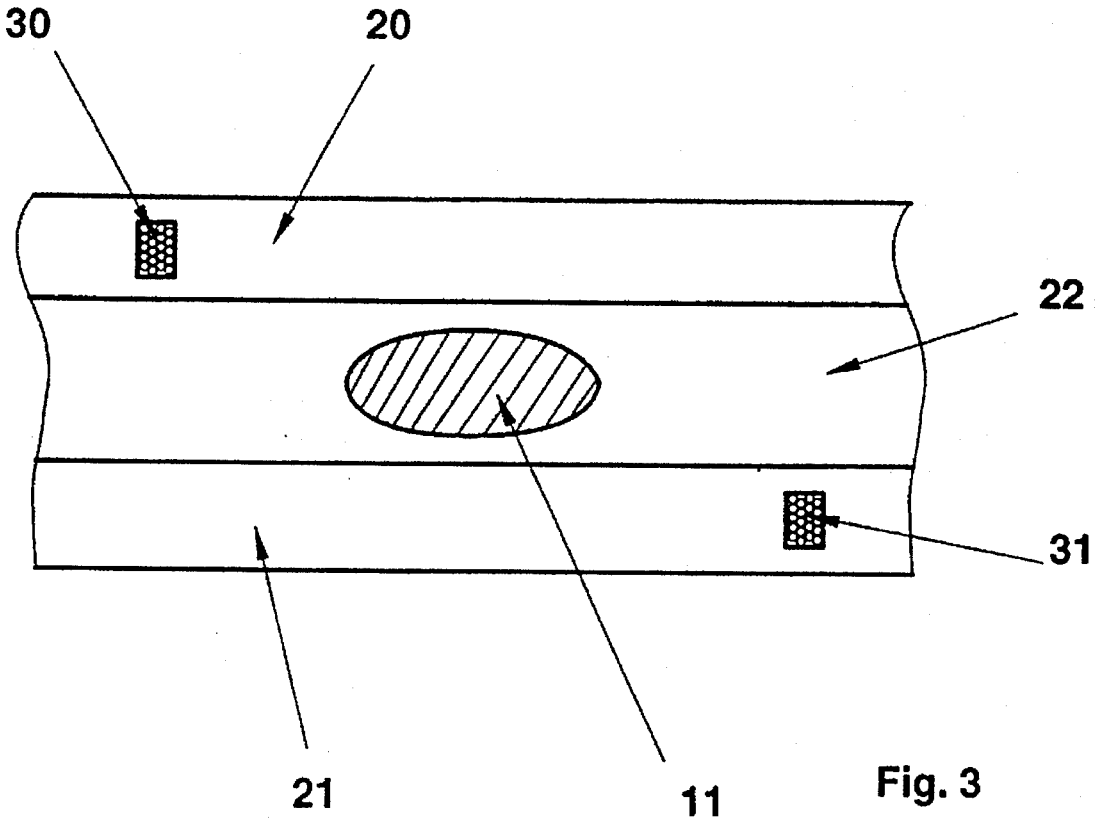
FIG. 3 is a diagrammatic section on the horizontal plane in FIG. 2 containing the axis YY'.

FIG. 3 shows the cross-section of the extension 11. Its profile is symmetrical because the carriage can move in both directions. It has an oblong shape designed to minimize the compression/rarefaction of the air in the space 22 on movement of the carriage 6 and therefore to minimize turbulence to the rear of the moving extension 11. This avoids disturbance to the flow outside the space 22 and in particular aspiration of air in the vicinity of the sprayers 7 and 8.

Figure 4B:
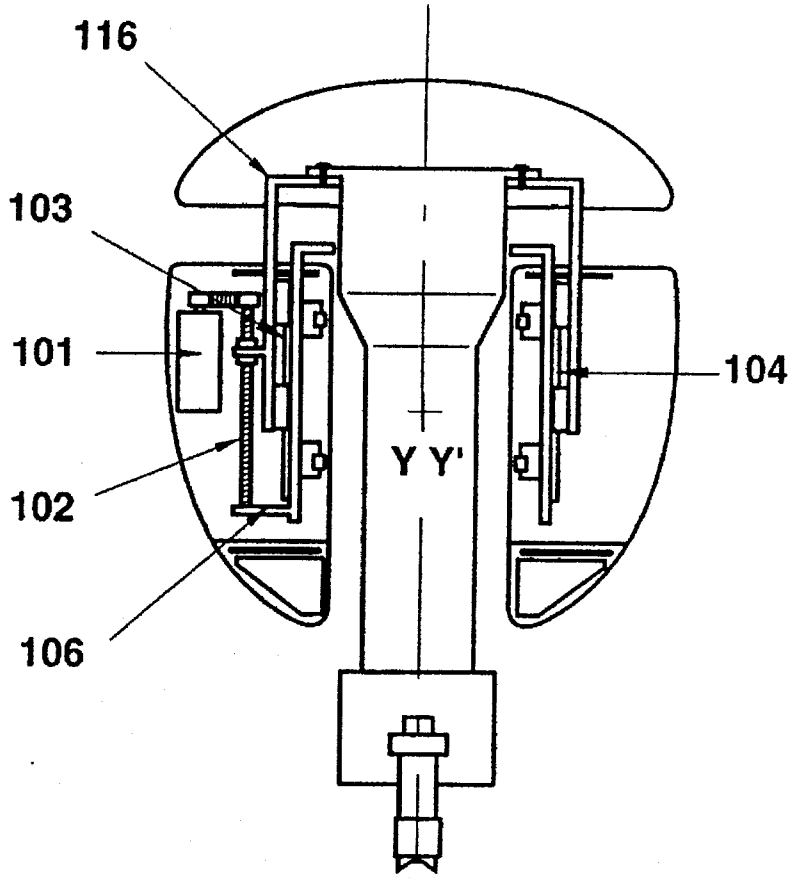
FIGS. 4*a* and 4*b* are views in elevation in the direction of the arrow IV in FIG. 2 showing the carriage and its two longitudinal members in another embodiment of the invention.
Figure 4A:
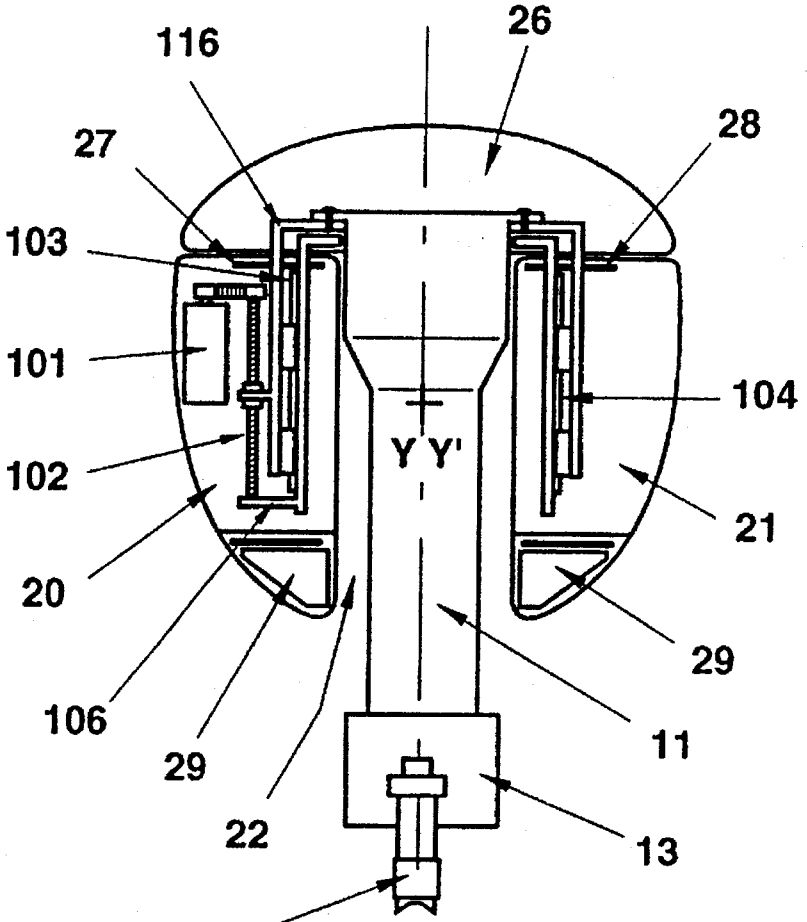

The embodiment of the invention shown in FIGS. 4*a* and 4*b* differs from that shown in FIGS. 1 to 3 in that the distance of the sprayers 7 and 8 from the axis YY' is variable. Components identical to those shown in FIG. 2 are identified by the same reference numbers. In FIG. 4*a* the distance between the sprayers 7 and 8 and the beam 5 is at its maximum. In FIG. 4*b* this distance is reduced and the sprayers are closer to the beam. A motor 101 associated with a recirculating ball screw 102 is mounted on a carriage 106 attached to the belts 27 and 28. A second carriage 116 fastened to the nut of the recirculating ball screw and supporting the upper part of the carriage 26 and the extension 11 can be moved up and down on rails 103 and 104 carried by the carriage 106 and perpendicular to the axis YY'.

This translatory movement and the rotation of the shaft 12 about the wrist 13 enable the sprayers 7 and 8 to be maintained at all times perpendicular to and at the optimal distance from the object to be coated.

A similar result could be obtained with a telescopic extension 11. In this case only the end of the extension 11 carrying the sprayers would be able to move perpendicularly to the axis YY'.

The invention applies equally to a painting device and to a powder coating device and can be used with one or more pneumatic, rotary, electrostatic or non-electrostatic sprayers. Its use is not limited to the field of automobiles, but encompasses all installations incorporating overhead machines.

Although described with reference to a beam carrying a single carriage, the invention also applies to the situation of several carriages on a beam. The sweeping movements of the carriages are then of reduced amplitude.

There is claimed:

1. Coating product sprayer device in the form of an overhead machine, said device comprising a beam supporting at least one carriage carrying at least one coating product sprayer wherein said beam comprises two longitudinal members parallel to and spaced from each other and defining between them a space and said at least one carriage moves between said two longitudinal members and lies at least partially in said space.

2. Device according to claim 1 in combination with a spray booth provided with means for creating therein a dominant flow of air, wherein said device is installed in said spray booth and said beam is disposed so that said dominant flow of air causes in said space defined between said two longitudinal members a flow of air in substantially the same direction as that in which a coating product is sprayed by said at least one coating product sprayer.

3. The combination according to claim 2 wherein said at least one carriage extends through said space.

4. The combination according to claim 3 wherein said beam has a rotation axis, said at least one carriage is displaced along said beam by a set of belts disposed on respectively opposite sides of the rotation axis of said beam and said device further comprises bearing means supporting said beam for rotation about the rotation axis.

5. The combination according to claim 2 wherein said at least one sprayer is accommodated at the end of an extension of said one at least carriage on the side facing towards objects to be coated.

6. The combination according to claim 5 wherein said coating product sprayer is fixed to an arm coupled to said extension by a wrist enabling pivoting of said arm.

7. The combination according to claim 5 wherein said extension has a profile shaped to generate minimal aerodynamic disturbance as it moves.

8. Device according to claim 1 wherein coating product supply hoses, air supply hoses and electrical cables are respectively accommodated in each of said two longitudinal members.

9. Device according to claim 1 wherein said beam has an axis and at least part of said at least one carriage carrying said at least one coating product sprayer is movable perpendicularly to the axis of said beam.

10. Device according to claim 1 wherein said beam has an axis and at least part of said at least one carriage carrying said at least one coating product sprayer is movable relative to said beam and perpendicularly to the axis of said beam.

11. Device according to claim 1 wherein said at least one carriage is supported jointly by said two longitudinal members of said beam.

12. Device according to claim 1 wherein said beam has an axis and said at least one carriage is movable as a unit parallel to the axis of said beam.

13. Device according to claim 1 wherein said beam has an axis, said at least one carriage includes one carriage which is supported jointly by said two longitudinal members of said beam, and said one carriage is movable as a unit parallel to the axis of said beam.

14. Device according to claim 1 wherein said carriage has an extension which extends substantially vertically through said space.

15. Device according to claim 1 further comprising support means supporting said beam for permitting vertical movement of said beam relative to said support means.

16. Device according to claim 1 wherein said two longitudinal members are spaced from each other in a horizontal direction.

* * * * *